US010852036B2

(12) United States Patent
Tsuda et al.

(10) Patent No.: US 10,852,036 B2
(45) Date of Patent: Dec. 1, 2020

(54) HEATING AND HOT WATER SUPPLY APPARATUS

(71) Applicant: NORITZ CORPORATION, Hyogo (JP)

(72) Inventors: Naoki Tsuda, Hyogo (JP); Yoshifumi Atobe, Hyogo (JP); Hiroshi Morimoto, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 303 days.

(21) Appl. No.: 16/032,082

(22) Filed: Jul. 11, 2018

(65) Prior Publication Data

US 2019/0032959 A1 Jan. 31, 2019

(30) Foreign Application Priority Data

Jul. 26, 2017 (JP) ..... 2017-144278

(51) Int. Cl.

| | |
|---|---|
| ***F24H 9/20*** | (2006.01) |
| ***F24H 9/14*** | (2006.01) |
| ***F24H 1/08*** | (2006.01) |
| ***F24D 19/10*** | (2006.01) |
| ***F24H 1/52*** | (2006.01) |

(52) U.S. Cl.

CPC ..... *F24H 9/2035* (2013.01); *F24D 19/1066* (2013.01); *F24H 1/08* (2013.01); *F24H 1/52* (2013.01); *F24H 9/144* (2013.01); *F24D 2220/0235* (2013.01); *F24D 2220/0271* (2013.01)

(58) Field of Classification Search

CPC ..... F24H 9/2035

See application file for complete search history.

(56) References Cited

U.S. PATENT DOCUMENTS

2011/0017152 A1* 1/2011 Min ..... F24D 19/1024 122/19.1
2011/0139259 A1* 6/2011 Nagata ..... F24D 19/1069 137/1

(Continued)

FOREIGN PATENT DOCUMENTS

JP 2005337632 A * 12/2005
JP 2011515647 5/2011

OTHER PUBLICATIONS

JP2005337632A—machine translation (Year: 2005).*

*Primary Examiner* — Nathaniel Herzfeld
(74) *Attorney, Agent, or Firm* — JCIPRNET

(57) ABSTRACT

A distribution valve controls a distribution ratio of a heat transfer medium between a hot water supply path including a heat exchanger for hot water supply and a beating circulation path through which the heat transfer medium is supplied to a heating terminal. A bypass flow rate control valve controls a bypass ratio which is a ratio of a flow rate of low temperature water introduced into a bypass pipe that bypasses the heat exchanger for hot water supply to a flow rate of low temperature water introduced into a water inlet pipe. The bypass ratio is regulated so that a hot water temperature detected by a temperature sensor reaches a hot water target temperature. During a simultaneous operation of hot water supply and heating, the distribution valve is controlled so that, when a bypass ratio is low, a distribution ratio is higher than when a bypass ratio is high.

17 Claims, 7 Drawing Sheets

(56) References Cited

U.S. PATENT DOCUMENTS

2011/0315091 A1* 12/2011 Adachi ..... F24D 19/1054
122/14.1
2012/0090560 A1* 4/2012 Iwama ..... G05D 23/1917
122/14.3
2015/0300661 A1* 10/2015 Park ..... F24H 1/523
237/8 R

* cited by examiner

HEATING AND HOT WATER SUPPLY APPARATUS

CROSS-REFERENCE TO RELATED APPLICATION

This application claims the benefit of Japanese Application Serial No. 2017-144278, filed on Jul. 26, 2017. The entirety of the above-mentioned patent application is hereby incorporated by reference herein and made a part of this specification.

BACKGROUND

Technical Field

The present disclosure relates to a heating and hot water supply apparatus and more specifically, to a heating and hot water supply apparatus that can perform a simultaneous operation of heating and hot water supply.

Description of Related Art

As an aspect of a hot water supply apparatus, a heating and hot water supply apparatus having both functions of a heating operation and a hot water operation (hot water supply operation) is known. Published Japanese Translation No. 2011-515647 of the PCT International Publication (Patent Document 1) discloses a configuration in which, when a distribution device for distributing a medium between heating and hot water supply is deployed, a simultaneous operation of heating and hot water supply can be performed.

PATENT DOCUMENTS

[Patent Document 1] Published Japanese Translation No. 2011-515647 of the PCT International Publication Patent Document 1 discloses that a distribution ratio of a heat transfer medium between a heating path and a hot water supply path is controlled according to a heating load and a hot water supply load. Specifically, it is described that control is performed such that either a distribution proportion for the heating path or a distribution proportion for the hot water supply path is made higher according to magnitudes of the heating load and the hot water supply load.

However, in Patent Document 1, there is no detailed description regarding a method of determining a magnitude of a hot water supply load and a heating load. On the other hand, in order to appropriately control a distribution ratio of the heat transfer medium in a simultaneous operation, it is important to quantitatively determine a balance between the hot water supply load and the heating load. In particular, if the distribution ratio cannot be controlled in reflecting changes in the hot water supply load, there is a concern of the stability of a hot water supply temperature becoming lower.

SUMMARY

The present disclosure is able to appropriately control a distribution ratio of a heat transfer medium between heating and hot water supply in a heating and hot water supply apparatus that can perform a simultaneous operation of heating and hot water supply according to distribution of a common heat transfer medium.

According to an aspect of the present disclosure, a heating and hot water supply apparatus includes a heating device configured to heat a heat transfer medium, a heating circulation path, a heat exchanger for hot water supply, a hot water supply path, a distribution control device, a water inlet pipe, a hot water delivery pipe, a bypass path, a bypass control device, a hot water supply port, first, second and third temperature detectors, and a control unit. The heat transfer medium heated by the heating device circulates to and from a heating terminal via the heating circulation path. The heat exchanger for hot water supply includes a primary-side path and a secondary-side path for heat exchange. The hot water supply path branches from the heating circulation path and is configured such that the heat transfer medium flows through the primary-side path of the heat exchanger for hot water supply without passing through the heating terminal and then joins the heating circulation path again. The distribution control device controls a distribution ratio which is a ratio of a flow rate of a heat transfer medium supplied to the hot water supply path to a total flow rate of the heat transfer medium heated by the heating device. The water inlet pipe is connected to an input side of the secondary-side path. The hot water delivery pipe is connected to an output side of the secondary-side path. Through the bypass path, low temperature water introduced into the water inlet pipe is guided to the hot water delivery pipe without passing through the secondary-side path. The bypass control device controls a bypass ratio which is a ratio of a flow rate of low temperature water introduced into the bypass path to a total flow rate of low temperature water introduced into the water inlet pipe. The hot water supply port is connected downstream from a connection point with the bypass path in the hot water delivery pipe. The first temperature detector detects a temperature of low temperature water introduced into the water inlet pipe. The second temperature detector is arranged upstream from the connection point in the hot water delivery pipe and detects a temperature of high temperature water heated through the secondary-side path. The third temperature detector is arranged downstream from the connection point in the hot water delivery pipe and detects a hot water temperature from the hot water supply port. The control unit regulates the bypass ratio by using the bypass control device so as to control the hot water temperature to a hot water target temperature on the basis of detection values of the first to third temperature detectors. In addition, the control unit controls the distribution control device so that, during a simultaneous operation of heating and hot water supply, when the bypass ratio is low, the distribution ratio is higher than when the bypass ratio is high.

DESCRIPTION OF THE EMBODIMENTS

Figure 1:
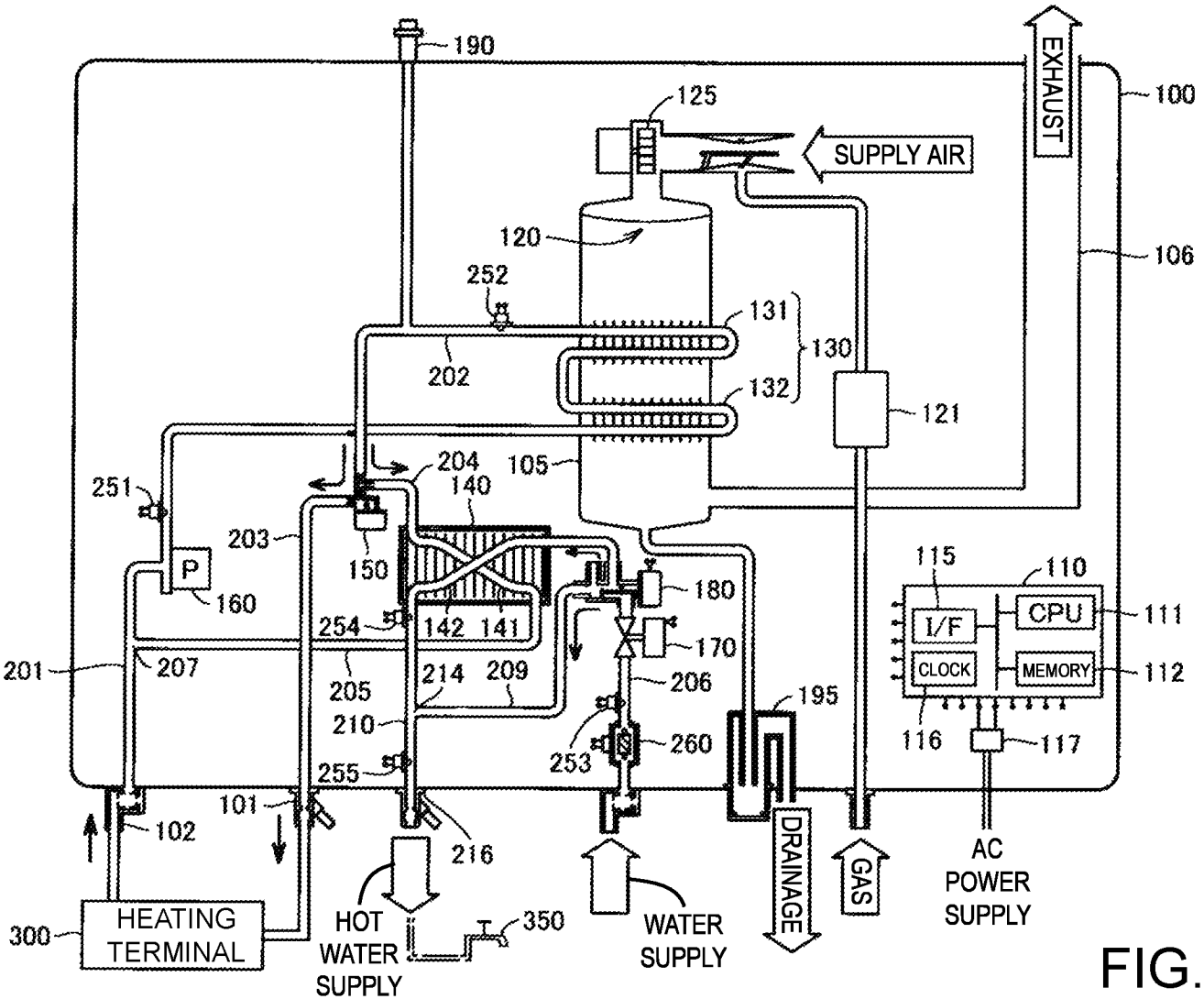
FIG. 1 is a block diagram explaining a configuration of a heating and hot water supply apparatus according to Embodiment 1.

Embodiments of the present disclosure will be described below in detail with reference to the drawings. Hereinafter, the same or corresponding components in the drawings will be denoted with the same reference numerals and descriptions thereof will not be repeated in principle.

Embodiment 1

FIG. 1 is a block diagram explaining a configuration of a heating and hot water supply apparatus according to Embodiment 1.

Referring to FIG. 1, a heating and hot water supply apparatus 100 according to Embodiment 1 includes an output end 101 and an input end 102 connected to a heating terminal 300, a water inlet pipe 206 into which low temperature water such as tap water is introduced, and a hot water supply port 216 for supplying hot water to a hot water tap 350 or the like. In the heating and hot water supply apparatus 100, a heating function is realized by circulating a heat transfer medium (high temperature water) to the heating terminal 300 via the output end 101 and the input end 102. In addition, when low temperature water introduced into the water inlet pipe 206 is heated according to heat exchange with the heat transfer medium, a function of hot water supply from the hot water supply port 216 is realized.

First, a configuration related to a heating function of the heating and hot water supply apparatus 100 will mainly be described. The heating and hot water supply apparatus 100 further includes a can body 105 into which a combustion burner 120 and a heat exchanger 130 are built, an exhaust pipe 106, a controller 110, a suction type fan 125, a heat exchanger for hot water supply 140, a distribution valve 150, a circulation pump 160, and pipes 201 to 205.

The combustion burner 120 receives supply of a fuel represented as a gas and generates an amount of heat according to combustion of the fuel. The fuel is supplied to the combustion burner 120 via a flow rate control valve 121. Air for fuel combustion is introduced into the can body 105 by the suction type fan 125. When a degree of opening of the flow rate control valve 121 is changed according to control of the suction type fan 125, it is possible to control a flow rate of a gas supplied to the combustion burner 120, that is, an amount of heat generated in the combustion burner 120.

The heat exchanger 130 includes a primary heat exchanger 131 for heating a fluid according to mainly sensible heat due to fuel combustion in the combustion burner 120, and a secondary heat exchanger 132 for heating a fluid according to mainly latent heat of an exhaust gas due to fuel combustion.

A combustion exhaust gas generated according to combustion of the combustion burner 120 is discharged outside of the heating and hot water supply apparatus 100 via the exhaust pipe 106. In addition, in the secondary heat exchanger 132, acidic water (drainage) generated when combustion exhaust gases are cooled according to heat exchange for latent heat recovery and condense is neutralized by a neutralizing device (not shown) and then collected in a water seal trap 195 and discharged outside of the heating and hot water supply apparatus 100.

The input end 102 into which a heat transfer medium that has flowed through the heating terminal 300 is input is connected to the input side of the secondary heat exchanger 132 via the pipe 201. The output side of the primary heat exchanger 131 is connected to the pipe 202. The pipe 202 is connected to the pipes 203 and 204 via the distribution valve 150. The pipe 203 is connected to the output end 101 for outputting a heat transfer medium to the heating terminal 300. The pipe 204 is connected to the input side of a primary-side path 141 of the heat exchanger for hot water supply 140. The output side of the primary-side path 141 of the heat exchanger for hot water supply 140 is connected to the pipe 201 via the pipe 205.

A degree of opening of the distribution valve 150 is controlled by the controller 110. According to a degree of opening of the distribution valve 150, a ratio between a flow rate for a path from the pipe 202 to the pipe 203 and a flow rate for a path from the pipe 202 to the pipe 204 can be controlled. For example, a degree of opening of the distribution valve 150 may be controlled by the number of steps of a stepping motor (not shown) that drives a valve body (not shown) such that it is opened or closed.

The heating terminal 300 and a heating pump (not shown) are connected between the output end 101 and the input end 102. When the heating pump is operated, inside the heating and hot water supply apparatus 100, a "heating circulation path" for circulating a heat transfer medium to and from the heating terminal 300 is formed between the output end 101 and the input end 102. The heating circulation path includes the pipe 201, the heat exchanger 130, the pipe 202, the distribution valve 150, and the pipe 203. For example, the heat transfer medium may be high temperature water heated according to an amount of heat generated in the combustion burner 120 in the heat exchanger 130. That is, the combustion burner 120 and the heat exchanger 130 correspond to an example of a "heating device."

When the heat transfer medium is supplied to the heating terminal 300, it is possible to heat a space (indoor) in which the heating terminal 300 is deployed. That is, the heating and hot water supply apparatus 100 can realize a heating function by heating a heat transfer medium that flows through the heating circulation path formed by the operation of the heating pump described above.

In the heating circulation path, a pressure relief valve 190 is further provided. In addition, although not shown, a circuit for replenishment with tap water or the like when the amount of heat transfer medium is reduced is additionally connected to the heating circulation path.

When the heat transfer medium is introduced into the pipe 204 by the distribution valve 150, a "hot water supply path" branched from the heating circulation path can be formed for the heat transfer medium heated by the heat exchanger 130. The hot water supply path includes the pipe 204, the primary-side path 141 of the heat exchanger for hot water supply 140, and the pipe 205. The heat transfer medium that flows through the hot water supply path flows through the heat exchanger for hot water supply 140 (the primary-side path 141) without passing through the heating terminal 300, and then joins the heating circulation path at a connection point 207 between the pipes 201 and 205.

The circulation pump 160 is arranged downstream (side on the heat exchanger 130) from the connection point 207 in the pipe 201. Therefore, when the circulation pump 160 is operated, even if the heating circulation path is not formed by an operation of the heating pump, it is possible to form the hot water supply path for allowing the heat transfer medium to flow through the heat exchanger 130 and the heat exchanger for hot water supply 140.

According to a degree of opening of the distribution valve 150, for the heat transfer medium heated by the heat exchanger 130, it is possible to control a ratio between a supply flow rate for the heating circulation path and a supply flow rate for the hot water supply path. Hereinafter, a ratio of the flow rate supplied to the hot water supply path to a total flow rate of the heat transfer medium output from the heat exchanger 130 will be also referred to as a distribution ratio $\eta x$. The distribution ratio $\eta x$ is controlled between $\eta x=0$ (that is, the entire amount of the heat transfer medium flows through the heating circulation path) and $\eta x=1.0$ (that is, the entire amount of the heat transfer medium flows through the hot water supply path) ($0 \leq \eta x \leq 1.0$). The distribution ratio $\eta x$ due to the distribution valve 150 can be controlled by the number of steps of the above stepping motor (not shown). The distribution valve 150 corresponds to an example of a "distribution control device."

Next, constituents connected to a secondary-side path 142 of the heat exchanger for hot water supply 140 related to a hot water supply function of the heating and hot water supply apparatus 100 will be described.

The heating and hot water supply apparatus 100 includes a bypass pipe 209, a flow rate regulating valve 170, and a bypass flow rate control valve 180 in addition to the water inlet pipe 206 and a hot water delivery pipe 210.

When the hot water tap 350 is opened, low temperature water is introduced from the water inlet pipe 206 due to a water pressure of tap water or the like. The water inlet pipe 206 is connected to the input side of the secondary-side path 142 of the heat exchanger for hot water supply 140. The hot water delivery pipe 210 is connected between the output side of the secondary-side path 142 of the heat exchanger for hot water supply 140 and the hot water supply port 216. In the heat exchanger for hot water supply 140, according to an amount of heat of the heat transfer medium that flows through the primary-side path 141, low temperature water that flows through the secondary-side path 142 is heated. As a result, high temperature water is output from the secondary-side path 142 to the hot water delivery pipe 210.

The bypass pipe 209 is provided to form a bypass path of the heat exchanger for hot water supply 140 between the water inlet pipe 206 and the hot water delivery pipe 210. In the hot water delivery pipe 210, a junction 214 with the bypass pipe 209 is provided. The hot water supply port 216 is connected to the hot water delivery pipe 210 downstream from the junction 214. Therefore, hot water with a suitable temperature in which high temperature water heated by the heat exchanger for hot water supply 140 and low temperature water that has passed the bypass pipe 209 are mixed is supplied from the hot water supply port 216 to the hot water tap 350 or the like.

The bypass flow rate control valve 180 is provided in the bypass pipe 209. According to a degree of opening of the bypass flow rate control valve 180, a ratio of a flow rate of low temperature water introduced into the bypass pipe 209 to a total flow rate of low temperature water introduced into the water inlet pipe 206 (hereinafter referred to as a bypass ratio $\eta$) is controlled. The bypass ratio $\eta$ corresponds to a mixing ratio between high temperature water and low temperature water. For example, in the same manner as in the distribution valve 150, the bypass ratio $\eta$ due to the bypass flow rate control valve 180 can be controlled by the number of steps of a stepping motor (not shown) that drives a valve body (not shown) such that it is opened or closed. The bypass flow rate control valve 180 corresponds to an example of a "bypass control device."

The flow rate regulating valve 170 can be arranged in the water inlet pipe 206. For example, during a period in which a heating capacity becomes insufficient immediately after hot water supply is started, when a degree of opening of the flow rate regulating valve 170 is controlled so that a hot water flow rate is reduced, it is possible to prevent the hot water temperature from decreasing. In addition, also at a time other than immediately after hot water supply is started, in order to supply hot water according to a set hot water supply temperature at the time of a high flow rate, the hot water flow rate can be reduced according to control of a degree of opening of the flow rate regulating valve 170.

In the pipe 201, a temperature sensor 251 for detecting an input temperature Tin of a heat transfer medium in the heat exchanger 130 in the heating circulation path is provided. In the pipe 202, a temperature sensor 252 for detecting an output temperature Thm of the heat transfer medium heated by the heat exchanger 130 is deployed.

In addition, a temperature sensor 253 for detecting a temperature Tw of low temperature water introduced into the water inlet pipe 206 related to the hot water supply function is provided. A temperature sensor 254 for detecting a temperature Th of high temperature water is arranged on the output side of the secondary-side path 142 of the heat exchanger for hot water supply 140. In addition, downstream from the junction 214 of the hot water delivery pipe 210, a temperature sensor 255 for detecting a hot water temperature To after high temperature water and low temperature water are mixed is deployed. The temperature sensor 253 corresponds to an example of a "first temperature detector," the temperature sensor 254 corresponds to an example of a "second temperature detector," and the temperature sensor 255 corresponds to an example of a "third temperature detector."

The controller 110 operates by receiving supply of a power supply voltage (for example, DC 15 V) from a power supply circuit 117. The power supply circuit 117 converts power from an external power supply (for example, commercial AC power source) of the heating and hot water supply apparatus 100 into a power supply voltage.

The controller 110 includes a central processing unit (CPU) 111, a memory 112, an interface 115, and a clock part 116. The controller 110 can detect the date and time using the clock part 116. The controller 110 executes a program that is stored in the memory 112 in advance, and controls operations of components so that the heating and hot water supply apparatus 100 is operated according to a user operation command.

In this manner, in the heating and hot water supply apparatus 100, according to control of a distribution ratio of the heat transfer medium by the distribution valve 150, it is possible to selectively perform a simultaneous operation of heating and hot water supply, a single heating operation with only a heating function (hereinafter simply referred to as a heating operation), and a single hot water supply operation with only a hot water supply function (hereinafter simply referred to as a hot water supply operation). That is, hot water supply is performed in each of the hot water supply operation and the simultaneous operation, and heating is performed in each of the heating operation and the simultaneous operation.

Figure 2:
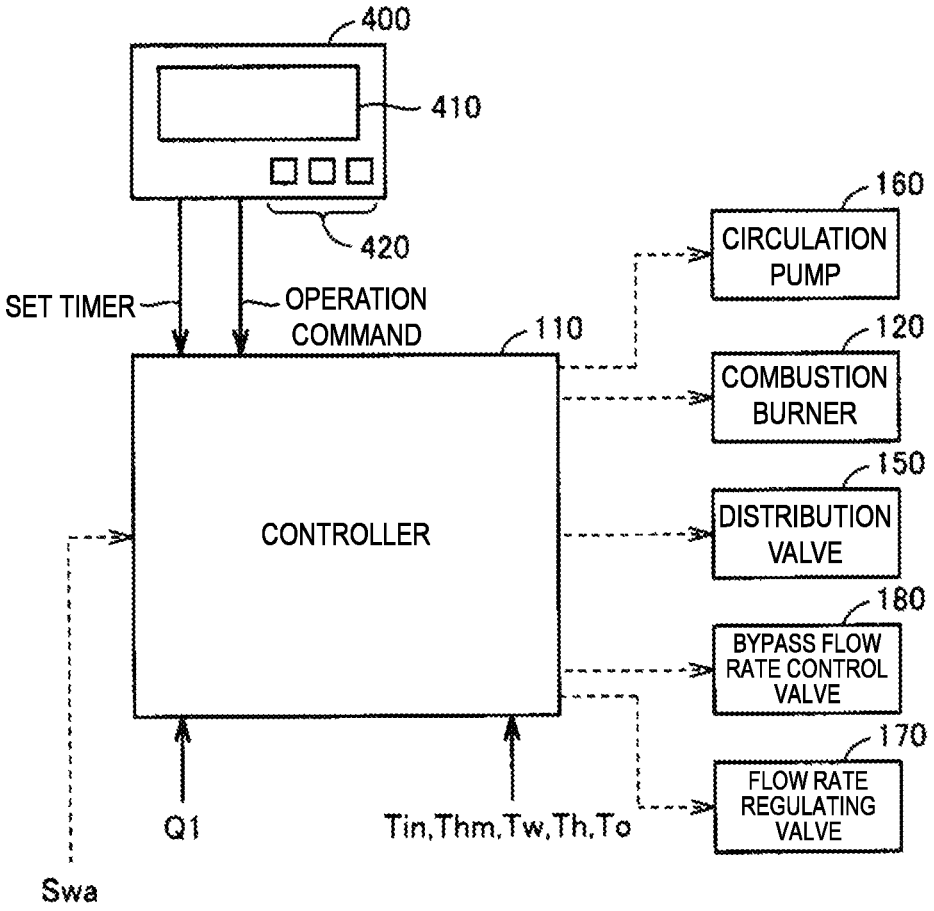
FIG. 2 is a functional block diagram explaining operation control of a heating and hot water supply apparatus by a controller shown in FIG. 1.

FIG. 2 shows a functional block diagram explaining operation control of the heating and hot water supply apparatus 100 by the controller 110.

Referring to FIG. 2, the controller 110 is connected to a remote controller (hereinafter simply referred to as a "remote controller") 400 of the heating and hot water supply apparatus 100 via a communication line (for example, a 2-core communication line). Bidirectional communication is possible between the remote controller 400 and the controller 110.

In the remote controller 400, a display unit 410 and an operation unit 420 are provided. The user can input an operation command of the heating and hot water supply apparatus 100 using the operation unit 420. The operation command includes an operation on and off command of the heating and hot water supply apparatus 100, a hot water supply set temperature in the hot water supply operation and the simultaneous operation, and a heating capacity in the heating operation and the simultaneous operation. The display unit 410 can be formed of a liquid crystal panel. The display unit 410 can visually display an operation state of the heating and hot water supply apparatus 100 and information indicating details of the set operation command. Alternatively, a part or the whole of the operation unit 420 can be formed using a partial area of the display unit 410 formed of a touch panel.

The operation command input to the remote controller 400 is transmitted to the controller 110. In addition, the input temperature Tin and the output temperature Thin of the heat transfer medium detected by the temperature sensors 251 to 255 and a low-temperature water temperature Tw, a high-temperature water temperature Th and a hot water temperature To are input. In addition, a flow rate detection value Q1 of a flow rate sensor 260 is input to the controller 110. In addition, a signal Swa from the side of the heating terminal 300 can be input to the controller 110. For example, the signal Swa includes a signal indicating whether there is a heating request from the heating terminal 300.

The controller 110 controls components of the heating and hot water supply apparatus 100 in order to switch between a heating operation, a hot water supply operation, and a simultaneous operation and perform an operation according to a set command value (specifically, the hot water supply set temperature and the heating capacity) of each operation so that the heating and hot water supply apparatus 100 is operated according to the operation command input to the remote controller 400. Specifically, the controller 110 outputs a signal for controlling operation and stopping of the circulation pump 160, a signal for controlling a degree of opening of the distribution valve 150, a signal for controlling a degree of opening of the bypass flow rate control valve 180, a signal for controlling a degree of opening of the flow rate regulating valve 170, and a signal for controlling operation/stopping of the combustion burner 120 and an amount of heat generated (for example, a rotational speed control signal of the suction type fan 125). These signals are output from the controller 110 through the interface 115 according to control processing results in the CPU 111.

In the heating operation, the combustion burner 120 and the circulation pump 160 are operated and the distribution valve 150 is controlled so that the distribution ratio $\eta x=0$ is satisfied, and thus the heating circulation path for circulating a heat transfer medium to and from the heating terminal 300 is formed. When the heating and hot water supply apparatus 100 is brought into an operation on state according to input to the operation unit 420, if an heating request is input by the signal Swa, the controller 110 operates the circulation pump 160 and the combustion burner 120, and heats the heat transfer medium, and forms the above heating circulation path. The amount of heat generated in the combustion burner 120 is controlled so that the output temperature Thin of the heat transfer medium matches a target output temperature corresponding to the set heating capacity.

During the hot water supply operation, the circulation pump 160 and the combustion burner 120 operate and the distribution valve 150 is controlled so that the distribution ratio $\eta x=1.0$ is satisfied. That is, the entire amount of the heat transfer medium heated by the heat exchanger 130 flows through the hot water supply path. When the heating and hot water supply apparatus 100 is brought into an operation on state and there is no heating request, the controller 110 performs the hot water supply operation when the flow rate detection value Q1 of the flow rate sensor 260 is higher than a predetermined minimum flow rate according to opening of the hot water tap 350 or the like.

In the hot water supply operation, in the heat exchanger for hot water supply 140, low temperature water introduced from the water inlet pipe 206 into the secondary-side path 142 is heated by the heat transfer medium that flows through the primary-side path 141. As a result, from the hot water delivery pipe 210, high temperature water (high-temperature water temperature Th) heated by the heat exchanger for hot water supply 140 and low temperature water (low-temperature water temperature Tw) that has passed through the bypass pipe 209 are mixed and hot water can be supplied. When the bypass ratio $\eta$ is controlled by regulating a degree of opening of the bypass flow rate control valve 180, the hot water temperature To from the heating and hot water supply apparatus 100 is controlled to a hot water target temperature Tsv. In temperature control by the bypass ratio the following Formula (1) is satisfied. Therefore, in Formula (1), when To=Tsv is assigned, it is possible to obtain a theoretical value $\eta r$ of the bypass ratio according to Formula (2) from the high-temperature water temperature Th and the low-temperature water temperature Tw.

$$To=Th\cdot(1-\eta)+Tw\cdot\eta \tag{1}$$

$$\eta r=(Th-Tsv)/(Th-Tw) \tag{2}$$

During the heating operation ($\eta x=0$), when the flow rate detection value Q1 of the flow rate sensor 260 is higher than a predetermined minimum flow rate according to opening of the hot water tap 350 or the like, the controller 110 performs the simultaneous operation of heating and hot water supply. Similarly, during the hot water supply operation ($\eta x=1.0$), even if a heating request is input by the signal Swa, the simultaneous operation is performed.

In the simultaneous operation, the distribution ratio $\eta x$ by the distribution valve 150 is controlled to $0<\eta x<1.0$ so that the heat transfer medium is supplied to both the heating circulation path and the hot water supply path. In this case, when the distribution ratio $\eta x$ is low with respect to a hot water supply load, even if the bypass ratio $\eta$ is minimized, it is not possible to secure the hot water temperature To. In addition, when an amount of the heat transfer medium supplied to the heating terminal 300 is insufficient, there is a concern of the heating function being lowered. However, comparing the heating function and the hot water supply function, although a certain time is required before insufficient supply of the heat transfer medium lowers the heating capacity, there is a concern that a decrease in the hot water temperature To directly results in deterioration of user convenience.

Therefore, in the simultaneous operation, a hot water supply load is prioritized, that is, in a range in which a heat transfer medium flow rate for the hot water supply path for securing a hot water temperature is secured, the distribution ratio ηx is controlled so that an amount of the heat transfer medium supplied to the heating terminal 300 increases, which is efficient.

Therefore, in the heating and hot water supply apparatus 100 according to the present embodiment, the distribution ratio ηx by the distribution valve 150 is controlled on the basis of determination of a hot water supply margin as will be described below. Here, in the simultaneous operation, the hot water temperature To is controlled to the hot water target temperature Tsv by regulating (bypass ratio η) a degree of opening of the bypass flow rate control valve 180 in the same manner as in the hot water supply operation.

Figure 3:
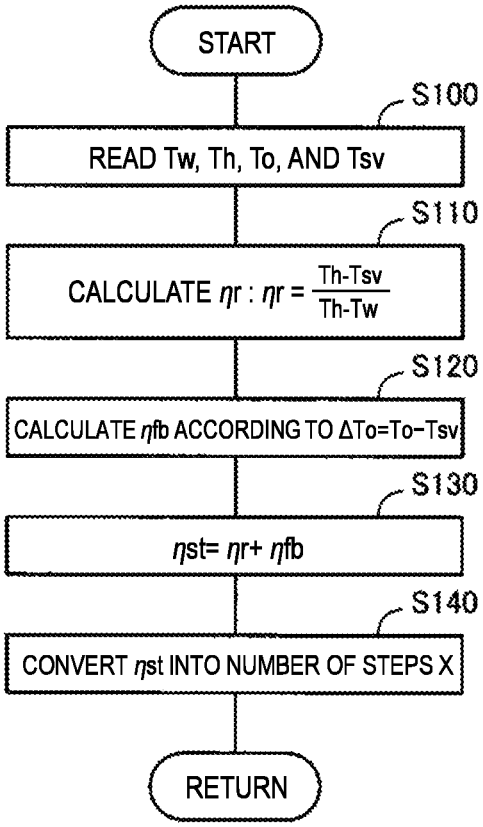
FIG. 3 is a flowchart explaining a control process of a hot water temperature control performed in a hot water supply operation and a simultaneous operation.

FIG. 3 is a flowchart explaining a control process of a hot water temperature control performed in the simultaneous operation and the hot water supply operation. The control process shown in FIG. 3 is repeatedly performed for each control period by the controller 110.

Referring to FIG. 3, in Step S100, the controller 110 reads the low-temperature water temperature Tw, the high-temperature water temperature Th and the hot water temperature To based on the detection values of the temperature sensors 253 to 255. In addition, in Step S100, the hot water target temperature Tsv input by the remote controller 400 is read. In Step S110, according to Formula (2), the controller 110 calculates a theoretical value ηr of the bypass ratio using the low-temperature water temperature Tw and the high-temperature water temperature Th and the hot water target temperature Tsv read in Step S110. Therefore, feedforward control of the bypass ratio η can be performed.

In addition, in Step S120, the controller 110 can combine the feedback control. In Step S120, a feedback control item ηfb of the bypass ratio is calculated based on a temperature deviation ΔTo with respect to the hot water target temperature Tsv (ΔTo=To−Tsv). For example, the feedback control item ηfb can be calculated according to proportional control (P control) or proportional integral control (PI control) of the temperature deviation ΔTo.

In Step S130, the controller 110 calculates a bypass ratio set value ηst. For example, the bypass ratio set value ηst can be calculated according to a sum of the theoretical value ηr (feedforward control item) and the feedback control item ηfb (ηst=ηr+ηfb). In Step S140, the controller 110 converts the bypass ratio set value list (S130) into the number of steps x for controlling a degree of opening of the bypass flow rate control valve 180.

Figure 4:
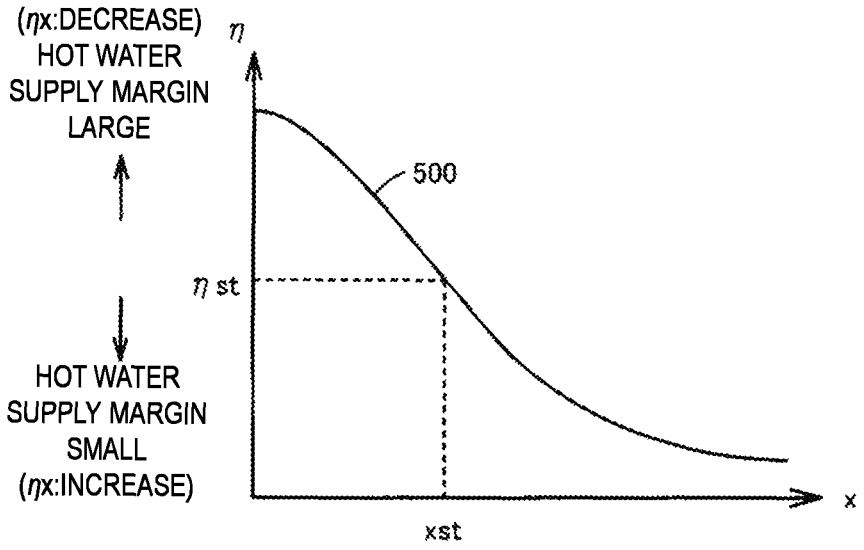
FIG. 4 is a conceptual diagram showing a relationship between the number of steps of a bypass flow rate control valve and a bypass ratio.

FIG. 4 is a conceptual diagram showing a relationship between the number of steps of the bypass flow rate control valve and the bypass ratio.

Referring to FIG. 4, a characteristic line 500 shows a set of plot points of the bypass ratio η with respect to the number of steps x of the bypass flow rate control valve 180. In the present embodiment, the bypass ratio η decreases as the number of steps x increases.

According to the characteristic line 500, when a relational expression or a table for back-calculating the number of steps x from the bypass ratio η is set in advance, the number of steps xst for realizing the bypass ratio set value ηst can be obtained. As a result, when a degree of opening of the bypass flow rate control valve 180 is controlled according to the number of steps xst calculated in Step S140, it can be controlled to the bypass ratio η=ηst.

Here, it can be understood that, when both sides of Formula (1) are differentiated with respect to η, since dTo/dη=Tw−Th<0 is satisfied, control for lowering the bypass ratio is performed in order to increase the hot water temperature To. In addition, according to the feedback control, when the hot water temperature To is lowered, since ΔTo (ΔTo=To−Tsv) is reduced, the hot water temperature To is secured by reducing the bypass ratio η.

Therefore, during the simultaneous operation, it is possible to determine a hot water supply margin focusing on the bypass ratio η by the hot water temperature control. Specifically, when the bypass ratio η is small, since the hot water supply margin is small, it can be determined that it is necessary to increase the distribution ratio ηx in order to secure the hot water temperature To. On the other hand, when the bypass ratio η is high, since the hot water supply margin is large, it can be determined that there is room to lower the distribution ratio ηx by the distribution valve 150.

Therefore, most simply, based on the bypass ratio η, when the bypass ratio η is small, the distribution valve 150 can be controlled so that the distribution ratio ηx is higher than when the bypass ratio η is large. However, the bypass ratio η tends to change relatively rapidly in order to control the hot water temperature To quickly. Therefore, in control of simply comparing the bypass ratio η with a reference value, there is a concern that the distribution ratio ηx may repeatedly increase and decrease excessively.

On the other hand, when the bypass ratio η is controlled so that To=Tsv is maintained, Formula (3) obtained by modifying Formula (1) is satisfied.

$$Th=(Tsv-Tw\cdot\eta)/(1-\eta) \quad 3)$$

In Formula (3), since Tsv and Tw over a very short time difference can be regarded as constants, the high-temperature water temperature Th is substantially a function of the bypass ratio η. When both sides of Formula (3) are differentiated with respect to the bypass ratio Formula (4) is obtained.

$$dTh/d\eta=\{-Tw\cdot(1-\eta)+(Tsv-Tw\cdot\eta)\}/(1-\eta)^2=(Tsv-Tw)/(1-\eta)^2 \quad (4)$$

Since Tsv>Tw is satisfied, dTh/dη>0 is obtained from Formula (4). Therefore, in hot water temperature control, the high-temperature water temperature Th monotonously increases with respect to the bypass ratio η.

Therefore, using the high-temperature water temperature Th that stably changes compared to the bypass ratio η, it is possible to indirectly evaluate a magnitude of the bypass ratio η that is, a magnitude of the hot water supply margin.

Figure 5:
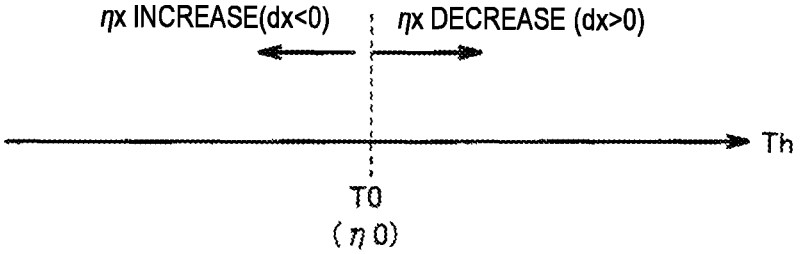
FIG. 5 is a conceptual diagram explaining a first example of control of a distribution ratio using a high-temperature water temperature.

FIG. 5 shows a conceptual diagram explaining a first example of control of a distribution ratio using a high-temperature water temperature.

Referring to FIG. 5, when a reference value η0 is set in advance for the bypass ratio η, if η=η0 is assigned in Formula (3), using the hot water target temperature Tsv and the low-temperature water temperature Tw detected by the temperature sensor 253, it is possible to obtain a reference temperature To for the high-temperature water temperature Th shown in Formula (5).

$$T0=(Tsv-Tw\cdot\eta0)/(1-\eta0) \quad (5)$$

That is, the reference temperature To corresponds to the high-temperature water temperature Th when the hot water temperature To at the current low-temperature water temperature Tw reaches the hot water target temperature Tsv while the bypass ratio η is the reference value η0.

Therefore, when the high-temperature water temperature Th is higher than the reference temperature T0, it is determined that a hot water supply margin is large and the distribution ratio ηx is lowered below the current value. On the other hand, when the high-temperature water temperature Th is lower than the reference temperature T0, it is determined that a hot water supply margin is small, and the distribution valve 150 can be controlled so that the distribution ratio ηx is increased above the current value.

Here, in Formula (5), when the low-temperature water temperature Tw is reflected in the reference temperature To and the low-temperature water temperature Tw is low, the reference temperature To is set to be relatively high, and thus it can be understood that the hot water supply margin is likely to be determined to be relatively small.

Figure 6:
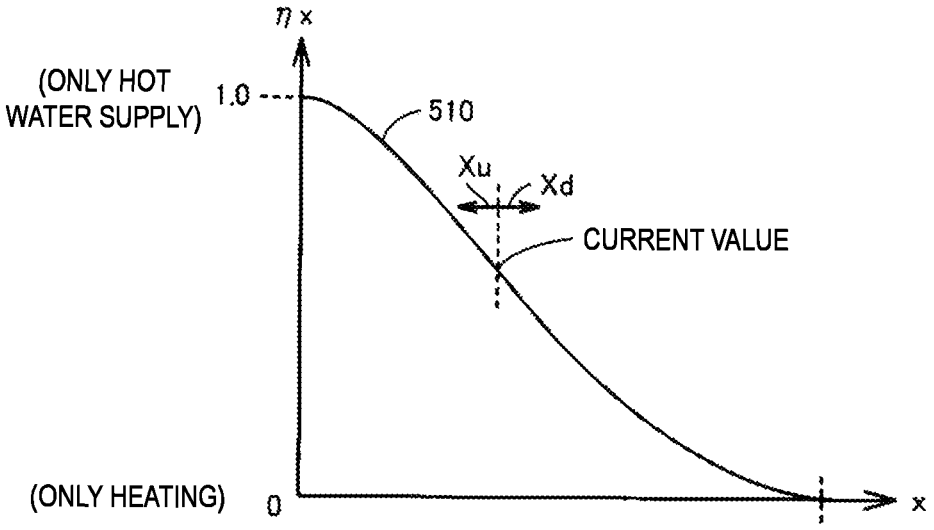
FIG. 6 is a conceptual diagram showing a relationship between a degree of opening of a distribution valve and a distribution ratio of a heat transfer medium.

FIG. 6 is a conceptual diagram showing a relationship between a degree of opening of a distribution valve and a distribution ratio of a heat transfer medium.

Referring to FIG. 6, a characteristic line 510 shows a set of plot points of the distribution ratio ηx of the heat transfer medium with respect to the number of steps x of the distribution valve 150. In the present embodiment, as the number of steps x decreases, the distribution ratio ηx increases, and an amount of the heat transfer medium supplied to the hot water supply path increases. On the other hand, as the number of steps x increases, the distribution ratio ηx decreases and an amount of the heat transfer medium supplied to the heating circulation path increases.

Again, referring to FIG. 5, the controller 110 sets an amount of change dx in the number of steps of the distribution valve 150 based on comparison between the high-temperature water temperature Th and the reference temperature To. In addition, the number of steps x of the distribution valve 150 is set according to a sum value Xsum of the amount of change dx.

When the high-temperature water temperature Th is lower than the reference temperature T0, the controller 110 sets the amount of change dx in the number of steps to a negative value (dx<0) and sets the distribution ratio ηx to be higher than a current value, and thus can increase an amount of the heat transfer medium supplied to the hot water supply path. Therefore, when the bypass ratio η is lowered in order to secure the hot water temperature To due to an increase in the hot water supply load, the amount of heat transfer medium that passes through the heat exchanger for hot water supply 140 increases, and thus it is possible to prevent the hot water supply temperature from decreasing.

On the other hand, when the high-temperature water temperature Th is higher than the reference temperature T0, the controller 110 sets the amount of change dx in the number of steps to a positive value (dx>0) and sets the distribution ratio ηx to be lower than a current value, that is, can increase an amount of the heat transfer medium supplied to the heating circulation path. Therefore, in a situation in which the hot water temperature To can be secured even if the bypass ratio η is large due to a decrease in the hot water supply load, it is possible to secure an amount of the heat transfer medium supplied to the heating terminal 300 without excessive supply of the heat transfer medium to the heat exchanger for hot water supply 140.

In this manner, when a magnitude of the hot water supply margin is indirectly determined by the high-temperature water temperature Th in correspondence with the low-temperature water temperature Tw and the bypass ratio η, the distribution ratio ηx of the heat transfer medium can be controlled.

Figure 7:
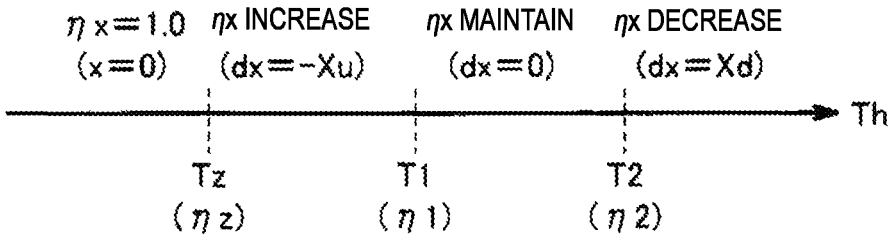
FIG. 7 is a conceptual diagram explaining a second example of control of a distribution ratio using a high-temperature water temperature.

Alternatively, as in a second example shown in FIG. 7, it is possible to more stably control the distribution ratio ηx by providing a plurality of stages for reference temperatures.

Referring to FIG. 7, when reference values η1 and η2 (η2>η1) are set in advance for the bypass ratio η, reference temperatures T1 and T2 can be determined by the following Formulae (6) and (7) using the hot water target temperature Tsv and the low-temperature water temperature Tw detected by the temperature sensor 253.

$$T1=(Tsv-Tw\cdot\eta1)/(1-\eta1) \quad (6)$$

$$T2=(Tsv-Tw\cdot\eta2)/(1-\eta2) \quad (7)$$

Since dTh/dη>0 is satisfied as shown in Formula (4), T2>T1 is satisfied according to η2>η1.

When the high-temperature water temperature Th is higher than the reference temperature T2, the amount of change dx in the number of steps=Xd (Xd>0) is set, and the distribution ratio ηx is reduced below the current value. Xd is a unit amount of change when the number of steps x is increased in order to lower the distribution ratio ηx and can be set in advance.

On the other hand, when the high-temperature water temperature Th is lower than the reference temperature T1, the amount of change dx in the number of steps=−Xu (Xu>0) is set and the distribution ratio ηx is increased above the current value. Xu is a unit amount of change when the number of steps x is reduced in order to increase the distribution ratio ηx and can be set in advance.

In the example in FIG. 7, in a range of T1<Th<T2, dx=0 is maintained and the current distribution ratio ηx is maintained. In this manner, when a range of dx=0 is set, the amount of change dx can be set so that the distribution ratio ηx of the heat transfer medium is maintained, increased, or decreased according to the hot water supply margin. In particular, when a region in which the distribution ratio ηx, that is, a degree of opening (the number of steps x) of the distribution valve 150, is maintained is set, it is possible to stably control the distribution valve 150.

In addition, a lower limit value ηz indicating a limit of the hot water supply margin is set for the bypass ratio η. In the same manner as in the reference temperatures To to T2, when η=ηz is assigned in Formula (3), it is possible to obtain a lower limit temperature Tz using the hot water target temperature Tsv and the low-temperature water temperature Tw (the temperature sensor 253).

Then, when the high-temperature water temperature Th is lower than the lower limit temperature Tz, the controller 110 clears the sum value Xsum so that the distribution ratio ηx=1.0 is satisfied (Xsum=0), and controls the number of steps x of the distribution valve 150 to 0. Therefore, in order to secure the hot water temperature T0, the entire amount of the heat transfer medium can be supplied to the hot water supply path (the heat exchanger for hot water supply 140). In this manner, when the bypass ratio η decreases due to an increase in the hot water supply load, if the entire amount of the heat transfer medium is supplied to the heat exchanger for hot water supply 140, it is possible to realize a simultaneous operation by placing priority on the hot water supply load. Here, even if the distribution ratio ηx=1.0 is established, when the hot water temperature To is lower than the hot water target temperature Tsv, control for reducing a flow rate of low temperature water by the flow rate regulating valve 170 can be additionally performed.

In this manner, according to the heating and hot water supply apparatus of Embodiment 1, in the simultaneous operation of heating and hot water supply according to distribution of a common heat transfer medium, when a hot water supply margin is determined on the basis of a hot water temperature control situation (the bypass ratio η or the high-temperature water temperature Th) and a distribution ratio of the heat transfer medium is appropriately controlled, it is possible to stably control the hot water supply temperature according to the hot water supply load. In addition, when the hot water supply load is low (when the hot water supply margin is large), it is possible to secure an amount of the heat transfer medium supplied to the heating terminal.

Embodiment 2

In Embodiment 2, special control of the distribution valve 150 during the heating operation in which hot water supply is stopped will be described.

In the heating and hot water supply apparatus 100, hot water is supplied by heat exchange between liquids in the heat exchanger for hot water supply 140. Therefore, when hot water supply starts at low temperatures in winter or the like, there is a concern that a long time will be taken for the hot water temperature To to reach the hot water target temperature Tsv. Therefore, it is preferable to provide a hot water supply preheating operation in order to heat the hot water supply path in advance in preparation to start hot water supply. For example, the hot water supply preheating operation can be activated according to a reservation start time input by the user using the remote controller 400.

Figure 8:
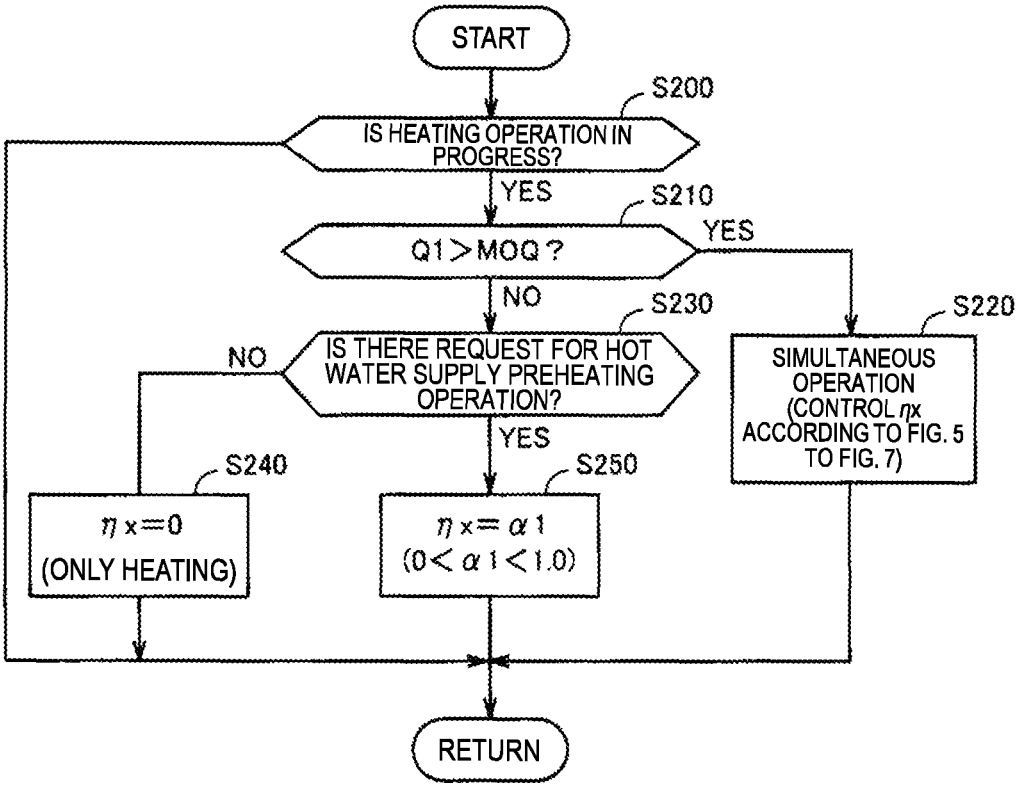
FIG. 8 is a flowchart explaining a first example of control of a distribution valve during a heating operation according to Embodiment 2.

FIG. 8 is a flowchart explaining a first example of control of a distribution valve during the heating operation according to Embodiment 2.

Referring to FIG. 8, in Step S200, the controller 110 determines whether a heating operation is in progress. When it is determined that a heating operation is in progress (when YES is determined in S200), the process advances to Step S210. That is, the control process shown in FIG. 8 is performed during the heating operation but it is not performed during non-execution of the heating operation.

In Step S210, the controller 110 compares the flow rate detection value Q1 (that is, a flow rate for the hot water supply path) of the flow rate sensor 260 with a minimum operation flow rate MOQ. When the flow rate detection value Q1 is higher than MOQ (when YES is determined in S210), the controller 110 advances the process to Step S220 and transitions to the simultaneous operation of heating and hot water supply. In the simultaneous operation, a degree of opening of the distribution valve 150, that is, the distribution ratio ηx of the heat transfer medium, is controlled according to the hot water supply margin as described in Embodiment 1 (FIG. 5 to FIG. 7).

When the flow rate detection value Q1 is equal to or lower than the minimum operation flow rate MOQ (when NO is determined in S210), the controller 110 determines whether there is a request for a hot water supply preheating operation in Step S230. For example, when a reservation start time of the hot water supply preheating operation input in advance to the remote controller 400 is compared with a current time detected by the clock part 116, and the reservation start time has been reached, YES is determined in Step S230.

When a hot water supply preheating operation is not requested during the heating operation (when NO is determined in S230), the controller 110 sets the distribution ratio ηx=0 in Step S240. That is, the distribution valve 150 performs control such that the entire amount of the heat transfer medium is supplied to the heating circulation path.

On the other hand, when the heating operation is in progress and there is a request for the hot water supply preheating operation (when YES is determined in S230), the controller 110 sets the distribution ratio ηx to a predetermined distribution ratio α1 (0<α1<1.0) in Step S250. Therefore, even if hot water supply is stopped (Q1<MOQ), a part of the heat transfer medium is caused to flow through the primary-side path 141 of the heat exchanger for hot water supply 140, and thus the hot water supply preheating operation can be realized. As a result, when hot water supply starts, it is possible to quickly increase the hot water temperature T0.

Alternatively, in the heating and hot water supply apparatus 100, a freeze prevention operation for preventing a hot water supply path from freezing when hot water has not been supplied for a long time in a severe cold season can be performed similarly.

Figure 9:
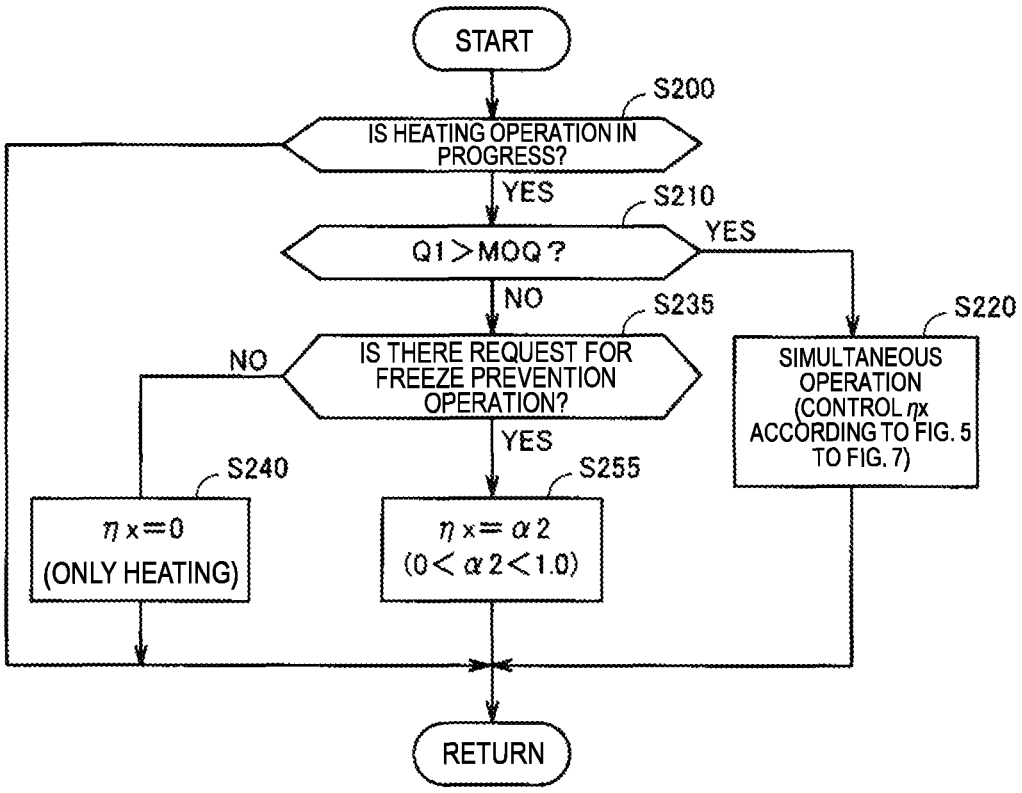
FIG. 9 is a flowchart explaining a second example of control of a distribution valve during a heating operation according to Embodiment 2.

FIG. 9 is a flowchart explaining a second example of control of a distribution valve during the heating operation according to Embodiment 2.

Referring to FIG. 9, in Steps S200 and S210 as in FIG. 8, when the flow rate detection value Q1 is higher than MOQ during the heating operation, the controller 110 performs the simultaneous operation of heating and hot water supply (S220).

On the other hand, when the flow rate detection value Q1 is equal to or lower than the minimum operation flow rate MOQ during the heating operation (when NO is determined in S210), the controller 110 determines whether there is a request for a freeze prevention operation in Step S235. For example, when an outside air temperature at a location at which the heating and hot water supply apparatus 100 is provided is a predetermined temperature or lower, if a timer value for measuring a time elapsed from when the heat transfer medium last flowed into the heat exchanger for hot water supply 140 reaches a predetermined value, YES is determined in Step S235.

When a freeze prevention operation is not requested during the heating operation (when NO is determined in S235), the controller 110 sets the distribution ratio ηx=0 in Step S240 as in FIG. 8.

Therefore, the entire amount of the heat transfer medium is supplied to the heating circulation path by the distribution valve 150.

On the other hand, when the heating operation is in progress and there is a request for the freeze prevention operation (when YES is determined in S235), the controller 110 sets the distribution ratio ηx to a predetermined distribution ratio α2 (0<a2<1.0) in Step S255. Therefore, even if hot water supply is stopped (Q1<MOQ), a part of the heat transfer medium is caused to flow through the primary-side path 141 of the heat exchanger for hot water supply 140, and since a path of the hot water delivery pipe 210, the water inlet pipe 206, the bypass flow rate control valve 180, and the like is warmed, through the secondary-side path 142, it is possible to prevent standing water from freezing.

In Step S255, the timer value used for determination in Step S235 is cleared. Therefore, even if hot water supply is stopped for a long period in a severe cold season, the freeze prevention operation can be performed at constant time intervals. In addition, the timer value is cleared according to the hot water supply preheating operation described in FIG. 8 or execution of general hot water supply (the hot water supply operation or the simultaneous operation). Therefore, the freeze prevention operation can be activated according to a length of a time for which the heat transfer medium does not actually flow through the heat exchanger for hot water supply 140.

In this manner, according to the heating and hot water supply apparatus of Embodiment 2, even during the heating operation in which hot water supply is turned off, the distribution valve 150 is controlled so that a part of the heat transfer medium is caused to flow through the primary-side path 141 of the heat exchanger for hot water supply 140, and thus the hot water supply preheating operation and the freeze prevention operation can be performed. Here, in the heating and hot water supply apparatus 100 according to Embodiment 2, it is possible to apply only one of the hot water supply preheating operation (FIG. 8) and the freeze prevention operation (FIG. 9).

According to an aspect of the present disclosure, a heating and hot water supply apparatus includes a heating device configured to heat a heat transfer medium, a heating circulation path, a heat exchanger for hot water supply, a hot water supply path, a distribution control device, a water inlet pipe, a hot water delivery pipe, a bypass path, a bypass control device, a hot water supply port, first, second and third temperature detectors, and a control unit. The heat transfer medium heated by the heating device circulates to and from a heating terminal via the heating circulation path. The heat exchanger for hot water supply includes a primary-side path and a secondary-side path for heat exchange. The hot water supply path branches from the heating circulation path and is configured such that the heat transfer medium flows through the primary-side path of the heat exchanger for hot water supply without passing through the heating terminal and then joins the heating circulation path again. The distribution control device controls a distribution ratio which is a ratio of a flow rate of a heat transfer medium supplied to the hot water supply path to a total flow rate of the heat transfer medium heated by the heating device. The water inlet pipe is connected to an input side of the secondary-side path. The hot water delivery pipe is connected to an output side of the secondary-side path. Through the bypass path, low temperature water introduced into the water inlet pipe is guided to the hot water delivery pipe without passing through the secondary-side path. The bypass control device controls a bypass ratio which is a ratio of a flow rate of low temperature water introduced into the bypass path to a total flow rate of low temperature water introduced into the water inlet pipe. The hot water supply port is connected downstream from a connection point with the bypass path in the hot water delivery pipe. The first temperature detector detects a temperature of low temperature water introduced into the water inlet pipe. The second temperature detector is arranged upstream from the connection point in the hot water delivery pipe and detects a temperature of high temperature water heated through the secondary-side path. The third temperature detector is arranged downstream from the connection point in the hot water delivery pipe and detects a hot water temperature from the hot water supply port. The control unit regulates the bypass ratio by using the bypass control device so as to control the hot water temperature to a hot water target temperature on the basis of detection values of the first to third temperature detectors. In addition, the control unit controls the distribution control device so that, during a simultaneous operation of heating and hot water supply, when the bypass ratio is low, the distribution ratio is higher than when the bypass ratio is high.

According to the heating and hot water supply apparatus, a hot water supply margin is determined by a bypass ratio regulated according to hot water temperature control of hot water supply, and when the bypass ratio is low, it is determined that the hot water supply margin is small, and the distribution ratio is increased. Therefore, it is possible to increase an amount of heat transfer medium supplied to the heat exchanger for hot water supply. As a result, it is possible to stabilize the hot water supply temperature by appropriately controlling a distribution ratio of the heat transfer medium between heating and hot water supply.

According to an embodiment of the disclosure, the control unit calculates a reference temperature of the high temperature water when the hot water temperature at a temperature of the low temperature water detected by the first temperature detector reaches the hot water target temperature while the bypass ratio is a predetermined reference value, and increases the distribution ratio when a temperature of the high temperature water detected by the second temperature detector is lower than the reference temperature.

In such a configuration, since it is possible to evaluate a magnitude of the hot water supply margin using the high-temperature water temperature which is linked to the bypass ratio and changes more stably than the bypass ratio, it is possible to stably control the distribution control device.

According to an embodiment of the disclosure, the control unit sets an amount of change in the distribution ratio on the basis of comparison of the detected temperature of the high temperature water with the reference temperature for each control period, the distribution ratio is controlled according to a sum value of the amount of change, and the amounts of change include both an amount by which the distribution ratio is increased, and an amount by which the distribution ratio is decreased.

In such a configuration, when the hot water supply margin is small, the distribution ratio is increased in order to secure the hot water temperature, and an amount of heat transfer medium supplied to the hot water supply path can be increased, and when the hot water supply margin is large, the distribution ratio is reduced and an amount of heat transfer medium supplied to the heating terminal can be increased. As a result, in a situation in which the hot water temperature can be secured even if the bypass ratio is high due to a decrease in the hot water supply load, it is possible to secure an amount of heat transfer medium supplied to the heating terminal without excessive supply of the heat transfer medium to the heat exchanger for hot water supply.

According to an embodiment of the disclosure, the control unit sets the amount of change of the distribution ratio for each control period to an amount by which the distribution ratio is maintained, an amount by which the distribution ratio is increased, or an amount by which the distribution ratio is decreased.

In such a configuration, it is possible to stably control the distribution control device by providing a region in which the distribution ratio is maintained.

According to an embodiment of the disclosure, the control unit calculates a lower limit temperature of the high temperature water when the hot water temperature at a temperature of the low temperature water detected by the first temperature detector reaches the hot water target temperature while the bypass ratio is a predetermined lower limit value and controls the distribution ratio so that the entire amount of the heat transfer medium is distributed through the hot water supply path when a temperature of the high temperature water detected by the second temperature detector is lower than the lower limit temperature.

In such a configuration, when the bypass ratio decreases due to an increase in the hot water supply load, if the entire amount of the heat transfer medium is supplied to the heat exchanger for hot water supply, it is possible to realize a simultaneous operation by placing priority on the hot water supply load.

According to an embodiment of the disclosure, when a hot water supply preheating operation is requested in a period in which a flow rate of the low temperature water in the water inlet pipe is not generated during a heating operation in which hot water supply is stopped, a distribution ratio is controlled by the distribution control device so that a part of the heat transfer medium is distributed through the hot water supply path.

In such a configuration, even during the heating operation in which hot water supply is stopped, the distribution ratio is controlled so that a part of the heat transfer medium is caused to flow through the primary-side path of the heat exchanger for hot water supply, and thus the hot water supply preheating operation for preventing the hot water temperature from dropping when hot water supply starts can be performed.

According to an embodiment of the disclosure, when a freeze prevention operation is requested in a period in which a flow rate of the low temperature water in the water inlet pipe is not generated during a heating operation in which hot water supply is stopped, a distribution ratio is controlled by the distribution control device so that a part of the heat transfer medium is distributed through the hot water supply path.

In such a configuration, even during the heating operation in which hot water supply is turned off, the distribution ratio is controlled so that a part of the heat transfer medium is caused to flow through the primary-side path of the heat exchanger for hot water supply, and thus the freeze prevention operation for preventing standing water in the water inlet pipe, the hot water delivery pipe, or the like from freezing can be performed.

According to the present disclosure, it is possible to appropriately control a distribution ratio of a heat transfer medium between heating and hot water supply in a heating and hot water supply apparatus that can perform a simultaneous operation of heating and hot water supply according to distribution of a common heat transfer medium.

The embodiments disclosed here are only examples in all respects and should not be considered as restrictive. The scope of the present disclosure is defined not by the above description but by the scope of the claims, and is intended to encompass equivalents to the scope of the claims and all modifications within the scope.

What is claimed is:

1. A heating and hot water supply apparatus comprising:

a heating device configured to heat a heat transfer medium;

a heating circulation path for circulating the heat transfer medium heated by the heating device to and from a heating terminal;

a heat exchanger for hot water supply including a primary-side path and a secondary-side path for heat exchange;

a hot water supply path which branches from the heating circulation path and through which the heat transfer medium flows through the primary-side path of the heat exchanger for hot water supply without passing through the heating terminal and then joins the heating circulation path again;

a distribution control device configured to control a distribution ratio which is a ratio of a flow rate of a heat transfer medium supplied to the hot water supply path to a total flow rate of the heat transfer medium heated by the heating device;

a water inlet pipe that is connected to an input side of the secondary-side path;

a hot water delivery pipe that is connected to an output side of the secondary-side path;

a bypass path through which low temperature water introduced into the water inlet pipe is guided to the hot water delivery pipe without passing through the secondary-side path;

a bypass control device configured to control a bypass ratio which is a ratio of a flow rate of low temperature water introduced into the bypass path to a total flow rate of low temperature water introduced into the water inlet pipe;

a hot water supply port that is connected downstream from a connection point with the bypass path in the hot water delivery pipe;

a first temperature detector configured to detect a temperature of low temperature water introduced into the water inlet pipe;

a second temperature detector that is arranged upstream from the connection point in the hot water delivery pipe and configured to detect a temperature of high temperature water heated along the secondary-side path;

a third temperature detector that is arranged downstream from the connection point in the hot water delivery pipe and configured to detect a hot water temperature from the hot water supply port; and a control unit configured to regulate the bypass ratio by using the bypass control device so as to control the hot water temperature to a hot water target temperature on the basis of detection values of the first to third temperature detectors, wherein the control unit controls the distribution control device so that, during a simultaneous operation of heating and hot water supply, when the bypass ratio is lowered, the distribution ratio is increased, and when the bypass ratio is increased, the distribution ratio is decreased, and wherein the control unit i) calculates a reference temperature of the high temperature water when the hot water temperature reaches the hot water target temperature in presence of a temperature of the low temperature water detected by the first temperature detector, while the bypass ratio is a predetermined reference value, and ii) increases the distribution ratio when a temperature of the high temperature water detected by the second temperature detector is lower than the reference temperature.

2. The heating and hot water supply apparatus according to claim 1, wherein the control unit sets an amount of change in the distribution ratio on the basis of comparison of the detected temperature of the high temperature water with the reference temperature for each control period, wherein the distribution ratio is controlled according to a sum value of the amount of change, and wherein the amounts of change include both an amount by which the distribution ratio is increased, and an amount by which the distribution ratio is decreased.

3. The heating and hot water supply apparatus according to claim 2, wherein the control unit sets the amount of change of the distribution ratio for each control period to an amount by which the distribution ratio is maintained, an amount by which the distribution ratio is increased, or an amount by which the distribution ratio is decreased.

4. The heating and hot water supply apparatus according to claim 1, wherein the control unit i) calculates a lower limit temperature of the high temperature water when the hot water temperature reaches the hot water target temperature in presence of a temperature of the low temperature water detected by the first temperature detector, while the bypass ratio is a predetermined lower limit value, and ii) controls the distribution ratio so that the entire amount of the heat transfer medium is distributed through the hot water supply path when a temperature of the high temperature water detected by the second temperature detector is lower than the lower limit temperature.

5. The heating and hot water supply apparatus according to claim 1, wherein, when a hot water supply preheating operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

6. The heating and hot water supply apparatus according to claim 1, wherein, when a freeze prevention operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

7. The heating and hot water supply apparatus according to claim 1, wherein the control unit i) calculates a lower limit temperature of the high temperature water when the hot water temperature reaches the hot water target temperature in presence of a temperature of the low temperature water detected by the first temperature detector, while the bypass ratio is a predetermined lower limit value, and ii) controls the distribution ratio so that the entire amount of the heat transfer medium is distributed through the hot water supply path when a temperature of the high temperature water detected by the second temperature detector is lower than the lower limit temperature.

8. The heating and hot water supply apparatus according to claim 5, wherein the control unit i) calculates a lower limit temperature of the high temperature water when the hot water temperature reaches the hot water target temperature in presence of a temperature of the low temperature water detected by the first temperature detector, while the bypass ratio is a predetermined lower limit value, and ii) controls the distribution ratio so that the entire amount of the heat transfer medium is distributed through the hot water supply path when a temperature of the high temperature water detected by the second temperature detector is lower than the lower limit temperature.

9. The heating and hot water supply apparatus according to claim 3, wherein the control unit i) calculates a lower limit temperature of the high temperature water when the hot water temperature reaches the hot water target temperature in presence of a temperature of the low temperature water detected by the first temperature detector, while the bypass ratio is a predetermined lower limit value, and ii) controls the distribution ratio so that the entire amount of the heat transfer medium is distributed through the hot water supply path when a temperature of the high temperature water detected by the second temperature detector is lower than the lower limit temperature.

10. The heating and hot water supply apparatus according to claim 1, wherein, when a hot water supply preheating operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

11. The heating and hot water supply apparatus according to claim 2, wherein, when a hot water supply preheating operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

12. The heating and hot water supply apparatus according to claim 3, wherein, when a hot water supply preheating operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

13. The heating and hot water supply apparatus according to claim 4, wherein, when a hot water supply preheating operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

14. The heating and hot water supply apparatus according to claim 1, wherein, when a freeze prevention operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

15. The heating and hot water supply apparatus according to claim 2, wherein, when a freeze prevention operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

16. The heating and hot water supply apparatus according to claim 3, wherein, when a freeze prevention operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

17. The heating and hot water supply apparatus according to claim 4, wherein, when a freeze prevention operation is requested in a period in which a flow rate of the low temperature water in the water inlet pipe is not generated during a heating operation in which hot water supply is stopped, the distribution ratio is controlled by the distribution control device so that a part of the heat transfer medium is distributed through the hot water supply path.

* * * * *